US005516047A

United States Patent [19]

Kubach et al.

[11] Patent Number: 5,516,047

[45] Date of Patent: May 14, 1996

[54] ELECTROMAGNETICALLY ACTUATED FUEL INJECTION VALVE

[75] Inventors: Hans Kubach, Hemmingen; Guenter Dantes, Eberdingen; Karlheinz Schultheiss, Weinsberg, all of Germany

[73] Assignee: Robert Bosch GmbH, Stuttgart, Germany

[21] Appl. No.: 295,345

[22] Filed: Aug. 24, 1994

[30] Foreign Application Priority Data

Aug. 24, 1993 [DE] Germany ..... 43 28 418.3

[51] Int. Cl.[6] ..... F02M 51/06; B05B 1/30; B05B 1/32

[52] U.S. Cl. ..... 239/585.5; 239/585.1

[58] Field of Search ..... 239/585.1–585.5

[56] References Cited

U.S. PATENT DOCUMENTS

| | | | |
|---|---|---|---|
| 4,421,280 | 12/1983 | Lewis et al. | 239/585.2 X |
| 4,520,962 | 6/1985 | Momono et al. | 239/488 |
| 4,666,087 | 5/1987 | Jaggle et al. | 239/585.3 X |
| 4,976,405 | 12/1990 | Graner et al. | 239/585.3 X |
| 4,982,716 | 1/1991 | Takeda et al. | 235/3 |
| 5,046,472 | 9/1991 | Linder | 239/585.4 X |
| 5,056,754 | 10/1991 | Graner et al. | 239/585.4 X |
| 5,188,336 | 2/1993 | Graner et al. | 239/585.3 X |
| 5,263,648 | 11/1993 | Vogt et al. | 239/585.4 |

FOREIGN PATENT DOCUMENTS

| | | | |
|---|---|---|---|
| 0057407 | 8/1982 | European Pat. Off. . | |
| 3533521 | 4/1987 | Germany . | |
| 4026721 | 2/1992 | Germany . | |
| 3-31571 | 2/1991 | Japan | 239/585.4 |
| 3-50376 | 3/1991 | Japan | 239/585.1 |
| 2180887 | 4/1987 | United Kingdom . | |

*Primary Examiner*—Andres Kashnikow
*Assistant Examiner*—Lesley D. Morris
*Attorney, Agent, or Firm*—Kenyon & Kenyon

[57] ABSTRACT

An electromagnetically actuated fuel injection valve for a fuel injection system of an internal combustion engine includes a valve housing, a magnet coil, and a valve needle. When the magnet coil is excited, the valve needle lifts off from its valve seat and allows fuel to pass. Downstream after the valve seat of the valve needle, two annular peripheral knife-edges face one another to generate one or more conical fuel lamellae extending in substantially laminar fashion. An annular metering gap is formed by the two knife-edges located close together such that the lower annular peripheral edge of the metering gap includes a stationary spray plate or a valve needle end piece.

13 Claims, 5 Drawing Sheets

ELECTROMAGNETICALLY ACTUATED FUEL INJECTION VALVE

FIELD OF THE INVENTION

The present invention relates to an electromagnetically actuated fuel injection valve.

BACKGROUND INFORMATION

The fuel injection valve according to the present invention, when viewed downstream to approximately the valve seat, is similar to conventionally configured injection valves, for example, dispenser injection valves as described in German patent application no. 35 33 521.

Proceeding therefrom, on the other hand, in functional terms, i.e. with reference to fuel delivery, the electromagnetic fuel injection valve according to the present invention has only a superficial similarity to a swirl valve as known, for example, from European Patent Application No. EP-OS 0 057 407, in that the fuel delivered by the fuel injection valve according to the present invention leaves the valve in the form of a conical lamella. Precisely in this respect, however, there are substantial differences between the present invention and known swirl valves in terms of both configuration and operation, which become evident especially in regard to a crucially finer droplet diameter. More detailed discussion below will therefore be devoted in particular to the operation of such known swirl valves, in which by means of a swirl extension— often arranged upstream from the valve needle seat—a swirl is imparted to the fuel escaping from the metering orifice so that it ultimately breaks apart into a conical lamella.

Also known in addition to the aforesaid dispenser injection valves and swirl valves are so-called apertured-spray valves, as described in German No. DE-OS 40 26 721, as well as impact valves, as described in U.S. Pat. No. 4,982, 716.

All of these valves provide better fuel conditioning characteristics than the usual single-orifice valves. In the apertured-spray valves, including cap valves, in which fuel is metered through fixed aperture plates, an orifice plate that is usually deformed into a spherical shape is present so as to optimize fuel inflow in terms of spray angle and other factors. If aperture plates are present, they are usually implemented by means of oblique orifices, as is clearly evident in German patent application no. DE-OS 40 26 721 in the orifice plate located downstream from the valve ball.

However, infeed to the injection holes becomes asymmetrical if even the slightest turbulence occurs, so that the spray angles are dynamically so dissimilar because of their long jet length and the predefined small emergence angle until preparation, that they collide with one another and atomization is lost. The number of holes cannot be made as great as required for extremely fine conditioning.

In swirl valves, structural problems that cannot be remedied by fine-tuning are evident particularly in the fact that the diameter of the spray-off edge is very small as compared to the lamella thickness. High outlet turbulence thus results, which causes detrimentally fluctuating lamella length and is further aggravated by subsidiary eddies.

There can also be delays in the creation of the actual swirl, i.e. such valves react with a dynamic lag, for example, initially forming a straight stream. Since it is theoretically based on the cyclone principle, friction is inherently relatively high. Because of the small proportion of surface energy in the lamella in a swirl valve, the conical angle cannot be made as great as would be desirable for optimum conditioning.

Since, however, the present invention also aims for and achieves a particularly laminar form of hollow conical lamella of injected fuel, it should also be noted, for purposes of comparison with and differentiation from the behavior of swirl valves, that in the latter— quantitative values being provided for better comprehension—the conical angle of 90 degrees achieved for a small Sauter diameter (SMD) is favorable but functionally too large, since the required conical angle is ≦60 degrees for a single-point injection system and ≦25 degrees for a multipoint system.

In addition, the available fuel pressure is often low. When the valve is activated, the differential pressure and the associated velocity of the emerging fuel are so low that the aforesaid straight stream results because: the long fluid column of the swirl spiral must be accelerated; the opening cross section of the seat valve, which initially is only partly open, is less than that of the swirl device or the metering gap, so that initially the maximum fuel velocity, which is useless for conditioning, is present in the seat; and the pump volume must first be filled during the valve's opening stroke.

For the sake of completeness, it should also be mentioned that in impact valves, for example in U.S. Pat. No. 4,982, 716, the fuel stream is directed onto an obstacle by which it can be deformed, for example into a turbulent conical lamella or into fan streams. Two streams can also be directed against one another in such impact valves.

If conditioning of the fuel in such valves is improved by air injection, then although the resulting Sauter diameter can be approximately halved, the droplet velocity is nevertheless typically tripled, which counteracts the desired final result of fine fuel misting with low droplet velocity.

SUMMARY OF THE INVENTION

The underlying object of the present invention is to configure an electromagnetically actuated fuel injection valve in such a way that while the valve is simple and cost-effective to manufacture, a substantially turbulent-free, i.e., laminar, thin lamella of fuel of typical hollow conical or tulip shape is produced. The fuel injection valve according to the present invention ensures, during the entire injection time, low droplet velocity and formation of extremely small droplets with good incorporation of the fuel into the air flowing into the engine.

The present invention produces hollow conical lamellae of fuel in an electromagnetically actuated fuel injection valve without the fundamentally different functional and structural forms known in swirl valves by arranging downstream from the valve seat special spray plates to form annular metering gaps which, again in substantial contradistinction to swirl valve functions, ensure underlying laminar characteristics in the hollow conical fuel shapes that are produced, with a preferred transition to tulip shapes resulting from surface tension and aerodynamic forces.

The fuel injection valve according to the present invention produces outstanding radial and circumferential spray angle distribution of the laminar fuel lamellae while forming very small droplets, even when these requirements become more stringent when a vacuum is present in the intake manifold (multipoint), since in such cases there is less deceleration of the droplets.

The configuration of an electromagnetically actuated fuel injection valve with a metering gap downstream from the valve seat, as provided by the present invention, results in crucial insensitivity to deposits, changes in stroke due to wear, and the effect of foreign particles. Furthermore, the fuel injection valve according to the present invention provides a particularly low dead volume between the metering gap and the valve seat, since at high temperature this fuel volume is normally evaporated and when the valve opens, it must first be carried off through the sealing seat without accurate metering.

The arrangement of an annular metering gap, formed by two edges by means of a central spray plate, creates at the fluid outlet a thin, conical lamella with a laminar profile and flow characteristics. A plurality of lamellae lying concentrically behind one another can also be generated. These lamellae are particularly thin at the droplet disintegration point, thus generating high surface energy that can be transferred, with little loss, into droplet surface energy. The greater the surface energy of the fuel lamella, the greater the conversion of radial energy of motion, including curvature, from the conical to the tulip shape, so that in desirable fashion the lamella rapidly becomes thinner after the flow emerges. Later, it can then extend in the air flow direction parallel to the wall of the intake manifold, thus preventing droplet impact there.

The present invention thus meets the following criteria, which also prevent rapid and irregular disintegration of the lamella with hole formation, specifically because: the lamellae of fuel are guided on both sides beginning at the valve outlet; the lamellae are already very thin at the valve outlet; the flow cross section converges strongly toward the annular constriction forming the metering cross section; the detachment angle of the lamella behind the constriction is approximately 90 degrees; and the knife-edge boundaries, and therefore the flow boundaries, are approximately symmetrical to the flow up to the knife-edge annular constriction.

As a result, and especially because the lamellae are guided on both sides of the valve outlet, thickness fluctuations due to asymmetrical inflow into the annular gap are prevented. Farther along the lamella, irregularities in the lamella are prevented by a low Reynolds number Re, Re being proportional to lamella thickness, at the lamella emergence point. In addition, high shear stress in the fluid at the lamella emergence point masks the influence of mass inertia, i.e., higher gradient in the velocity of flow to the constriction due to high convergence produces a thin laminar boundary layer, thus preventing discontinuous detachment of the boundary layer. Dirt and deposits are removed due to the high shear stress resulting from the thin boundary layer.

Also particularly advantageous in this connection is the arrangement of, for example, two annular metering gaps, which are then arranged concentrically to one another, and are provided with fuel via individual supply slits and one annular distributor. It is also possible, instead of the fixed stationary installation of a spray plate closing off the fuel injection valve in the downstream direction, to configure the spray plate as part of the valve needle, so that one of the sharp annular edges that form the annular metering gap is displaced relative to the other annular edge as the valve opens, and then, during the steady-state condition of the injection process, maintains a constant spacing.

DETAILED DESCRIPTION

Figure 1:
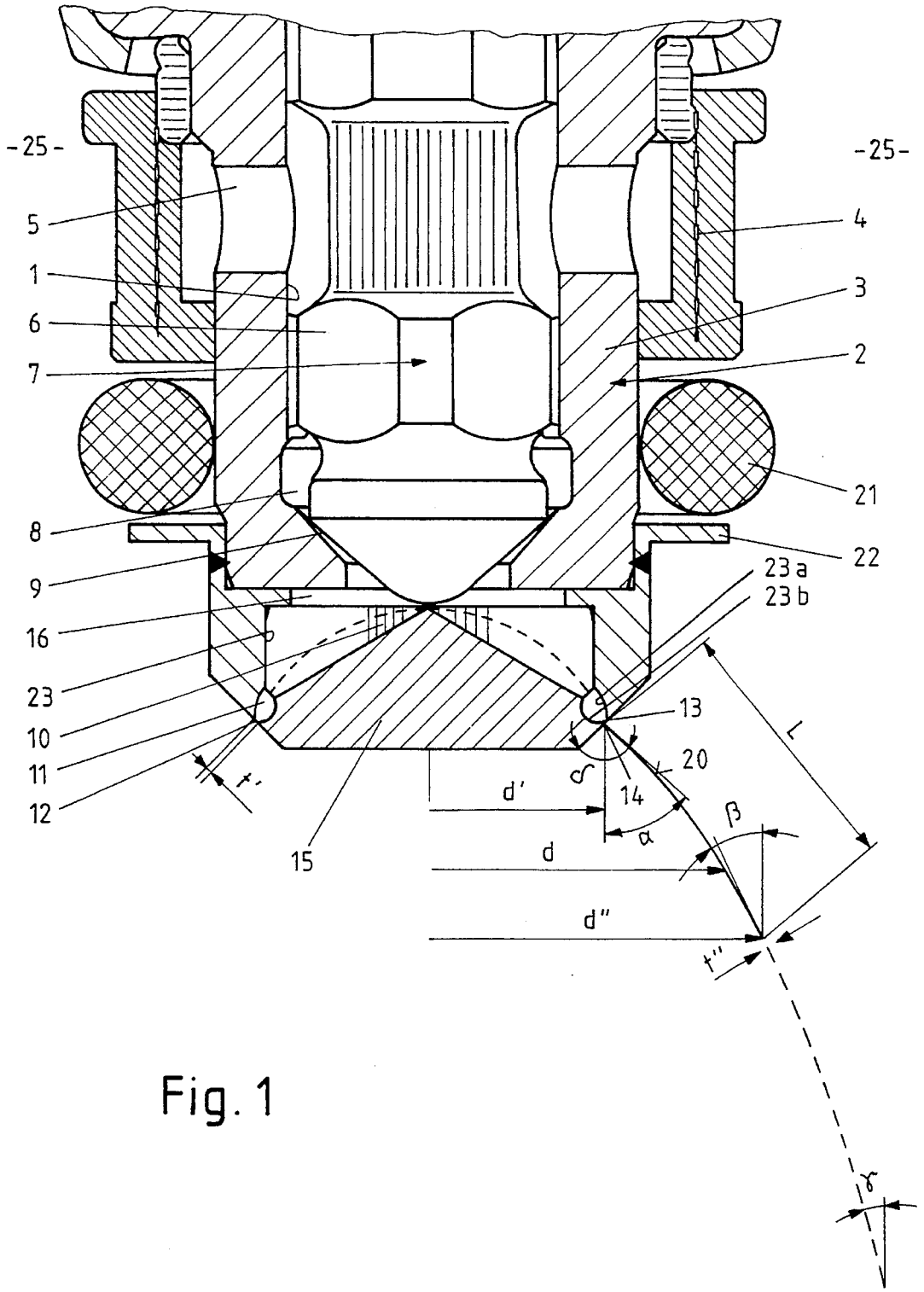
FIG. 1 shows a first preferred embodiment of the fuel injection valve according to the present invention with a fixed spray plate set in stationary fashion in a lower opening of the valve.

FIG. 1 depicts the lower part of an electromagnetically actuated fuel injection valve according to the present invention in section. The valve can be designed and configured in the upper region approximately like the fuel injection valve of German patent application no. 35 33 521. The valve closing member, configured as a valve needle 7, is mounted in housing 3 of a nozzle body 2 by means of guide sections 6 configured as bevels, which guide valve needle 7 in guide bore 1 of nozzle body 3 and leave open axial passages for the fuel. These guide sections can, for example, be configured with four sides.

FIG. 1 shows only the inner nozzle body region, omitting an outer valve housing in which it is mounted, although a seal 21 is indicated between the outer valve housing and the nozzle body. Fuel passes from outer space 25 through annular filter 4 and transverse bores 5, and past bevels 6, to annular fuel distributor 8 located in front of valve seat 9, when viewed in the flow direction, from which it passes in circularly symmetrical fashion to valve seat 9.

When the fuel injection valve is suitably activated, valve needle 7 lifts off from its valve seat 9, and fuel passes through a distributor opening 16 to the annular metering gap. A spray plate holder 22, which in the transition to the valve seat with reduced diameter also forms the distributor opening 16, is initially provided downwardly adjacent to the nozzle body in the flow direction, applied onto it with an overlapping bore, and permanently joined by crimping, for example. Bore 23, open downward, in spray plate holder 22 has slits 10 distributed over the inner periphery through which fuel then flows; this receives spray plate 15 as an insert and supports it. Hollows facing one another in concave fashion, which form an annular fuel distributor 11, are formed in the mutually facing rim region of spray plate holder 22 and spray plate 15. Hollows 23*a*, 23*b* on either side run outward toward one another and form annular edges 13, 14 that are aligned with one another, located opposite one another, and face one another, and form an acute annular opening gap with an outlet direction $\alpha$=45 degrees with respect to the axis. It should be expressly noted that the numerical values indicated here and hereinafter are provided solely for better comprehension, and do not limit the present invention.

These two edges 13, 14 form an annular metering gap 12 toward which the fuel flows in circularly symmetrical fashion via valve seat 9, distributor 16, slits 10, and annular distributor 11.

The sprayed lamella 20 of fuel is then ejected, for example, at an emergence angle $\alpha$=45 degrees with respect to the axis. Because of the surface tension of the fuel and the low air pressure on the inside of the spray cone, it curves into a tulip shape, so that the angle β at the disintegration diameter d" becomes less than α.

The annular metering gap formed between the annular edges 13, 14 is in the form of a small, narrow slit with a slit width t', so that when large volumes of fuel are being sprayed out, it is advisable for the diameter of the annular metering gap to be made as large as possible. This does not, however, necessarily mean a greater dead volume of delivered fuel with correspondingly increased switching inertia and greater damping, since the shape of the spray plate, which extends upward, i.e. against the flow direction, and tapers conically, takes up volume. An even greater reduction in dead volume is possible with an even greater bulge in the spray plate, for example, as additionally indicated in FIG. 1 with a dashed line.

The result is a highly convergent inflow toward the constriction of the annular metering gap, the flow cross section being smaller by a factor of 0.64–0.9, the contraction coefficient which depends on the inflow angle, than the geometrical opening. Here again, and in all the other exemplary embodiments in which numerical values are used, such information serves solely to improve understanding without any limitation of the invention.

The emergence angle α is a constant, independent of the pressure difference δp, at the annular gap. Since, however, angle β changes over time, e.g. after opening, with pressure difference δp because of the highly effective surface tension of the lamella guaranteed by the present invention, the additional advantage which results is that droplets produced at a later time after opening of the valve, at greater δp, can overtake earlier, slower droplets without colliding.

Because of the very narrow constriction at the annular metering gap, the fuel lamellae are thin as soon as they emerge at emergence diameter d', so that they are uniformly stretched even thinner to the greater conical diameter d" at the disintegration point, over the path length L as shown in FIG. 1, which is approximately independent of thickness.

Thus, a particularly large air volume, relative to the mass of gasoline, is available there for conditioning. At the time injection begins, this large mass of air represents a large inertial mass which provides the differential velocity between air and fuel required for energy exchange. Later in the injection process, the air at the disintegration point possesses an inherent eddying motion perpendicular to the lamella motion, which promotes conditioning as lamella thickness decreases, stabilizes the position of the disintegration point, and reduces angle γ shown in FIG. 1 in a desirable manner. This stabilization of the disintegration point is promoted by the fact that lamella thickness is in this case uniform, unlike swirl valves, for example.

The velocity index, i.e. the efficiency with which pressure energy is converted into velocity energy, is approximately 0.5 for swirl valves but almost 1.0 in the present case. Thus, when a preferred embodiment of the present invention is implemented in practice, much greater energy is available for conditioning. The low velocity index in swirl valves is highly dependent on time and temperature. It therefore leads to considerable and at times unacceptable changes in metering as a function of injection time.

The sharp edges present at the spray plate holder and the annular slit also ensure that very little dirt deposition occurs in this region, since deposition takes place mostly during the cooling phase of an internal combustion engine and arises from residual wetting with fuel. Because of surface tension, it is pulled back from the knife-edges. In addition, the high flow velocity gradient perpendicular to the knife-edges provides good cleaning by means of the metered fuel.

The droplet diameter that is achieved is only about 50 μm. As a result, the air resistance of the droplets is particularly high and the reduction of angle β to γ is correspondingly farther downstream from the valve because of the air flow generated by the droplets behind the disintegration point t".

Figure 2:
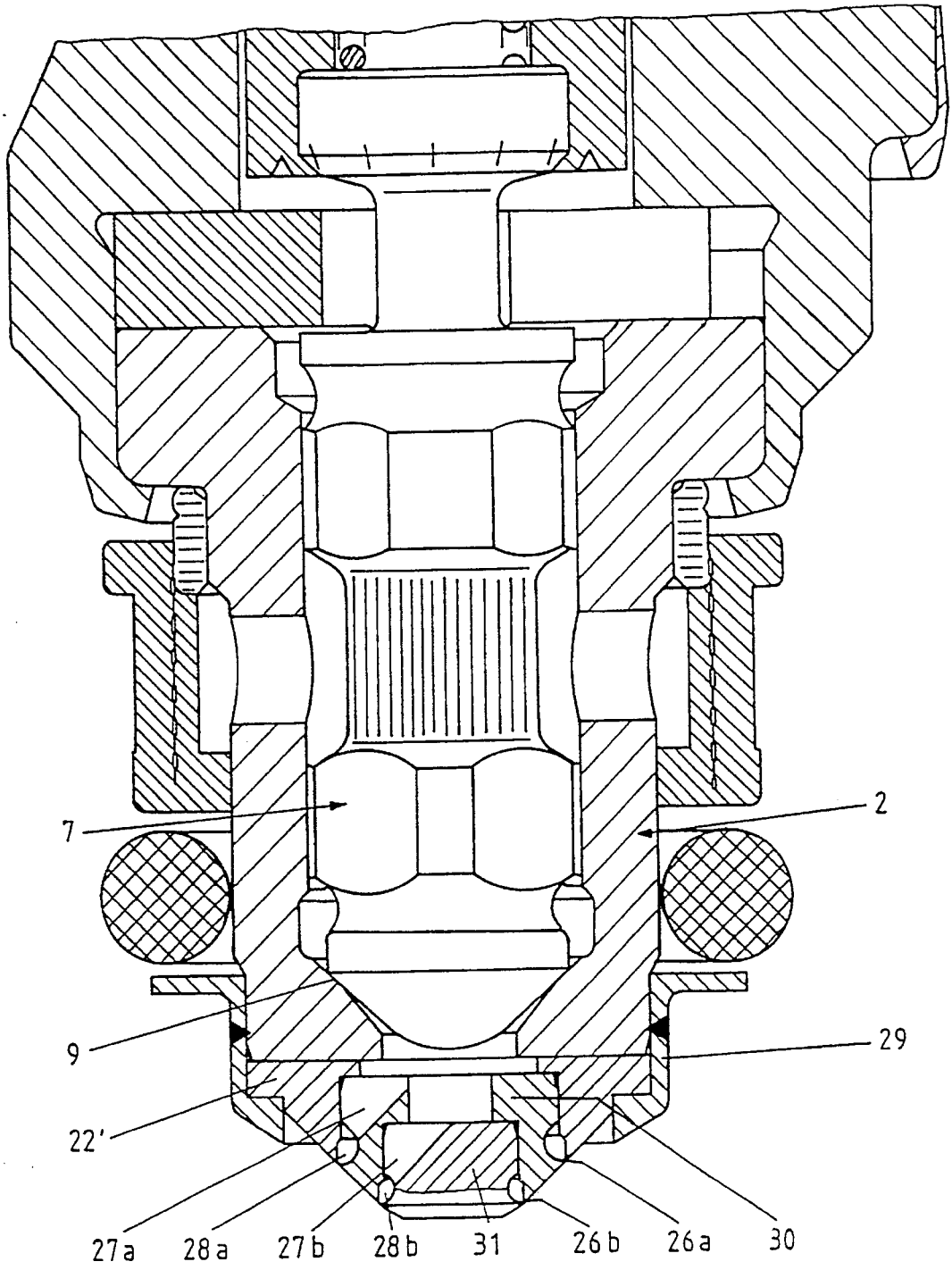
FIG. 2 shows a second preferred embodiment of the fuel injection valve according to the present invention with two annular metering gaps.

It may be advantageous to provide a plurality of concentric slits instead of an annular slit as provided in FIG. 1. In FIG. 2, two metering gaps 26*a*, 26*b*, one arranged concentrically with one another, are present and are provided with fuel via supply slits or passages 27*a*, 27*b* in the spray plates or inserts and associated annular distributors 28*a*, 28*b*.

The preferred embodiment shown in FIG. 2 corresponds approximately, up to valve seat 9 of valve needle 7, to the embodiment of FIG. 1, and has downstream a first spray plate holder 22' that is mounted on the lower end of housing 3 of nozzle body 2 by means of a separate annular mount 29. Spray plate holder 22' carries a first spray plate insert 30 that, together with the spray plate holder, forms annular metering gap 26*a* in the manner already explained above, and that in turn receives in a bore a further spray plate insert 31 that together with spray plate 30 forms the second annular metering gap 26*b*.

The plurality of such concentric annular slits, of which only two are depicted in FIG. 2 as annular metering gaps 26*a*, 26*b*, are correspondingly reduced in diameter relative to one another; their total length is the same for identical slit width and total cross section. The advantages of this design are: the dead volume, which is in any case small compared to swirl valves, can be further reduced and is then decidedly smaller than in swirl valves; the divergence of lamella thickness t' at lamella diameter d' along path length dL, according to the formula $dt/t'dL=\sin \alpha/d'$, can be increased for smaller d'; since the total path length L is constant, the surface energy is raised and the inequality $\beta<\alpha$ is enhanced; and the curvature of the droplet path for $\gamma<\beta$ is increased by a plurality of conical lamellae, since the air inside only a single conical lamella flows slightly backward in the axial direction—a plurality of conical lamellae prevents this backward flow, so that the air is pulled more strongly to the side of the spray cone and forced out forward, entraining the droplets inward.

Figure 3:
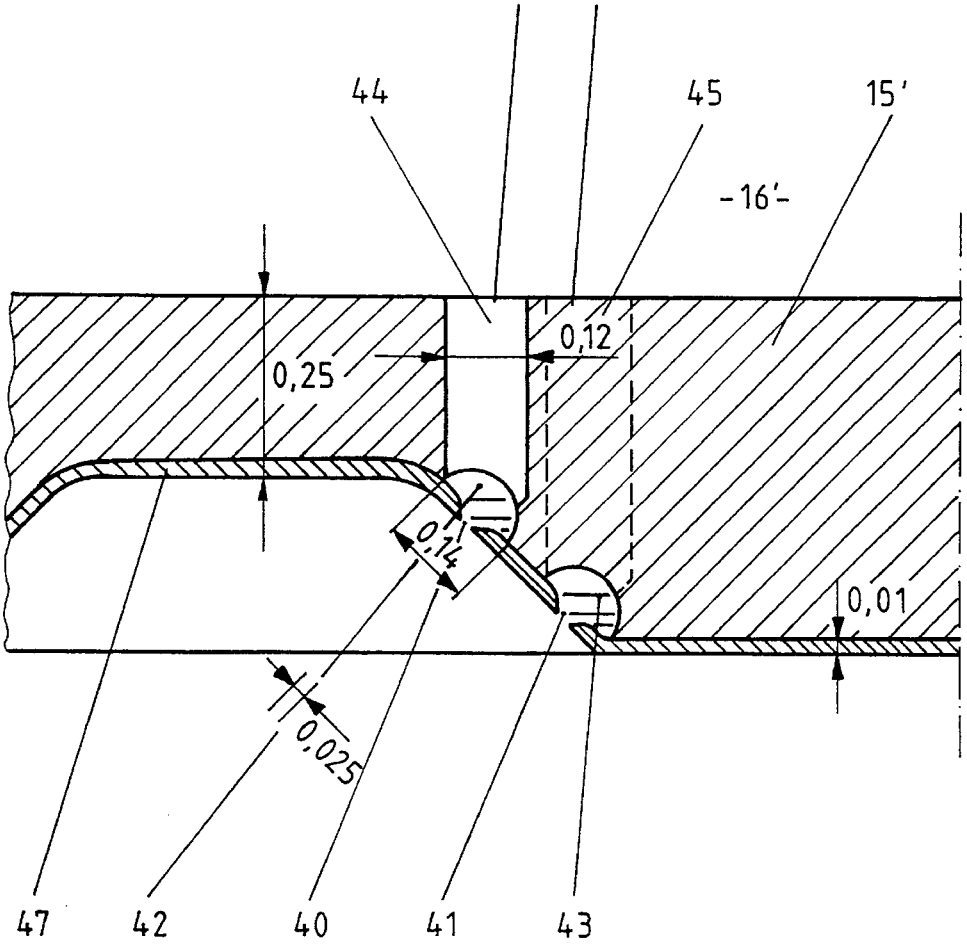
FIG. 3 shows a micromechanical third preferred embodiment of the fuel injection valve according to the present invention having a spray plate in a partial depiction with two or more metering gaps constricted in the flow direction.

FIG. 3 shows a micromechanical preferred embodiment of the present invention having a section of a spray plate 15' in which two or more metering gaps 40, 41, constricted in the flow direction, are set in a surface layer 47. The alignment of the surface layer on the spray plate body and the alignment of the gaps define the conical outward spray angle with a detachment angle of approximately 90 degrees. The fuel flows to the annular metering gaps from annular distributors 42, 43, to which it comes from a distributor 16' via infeed bores or slits 44, 45.

Figure 4:
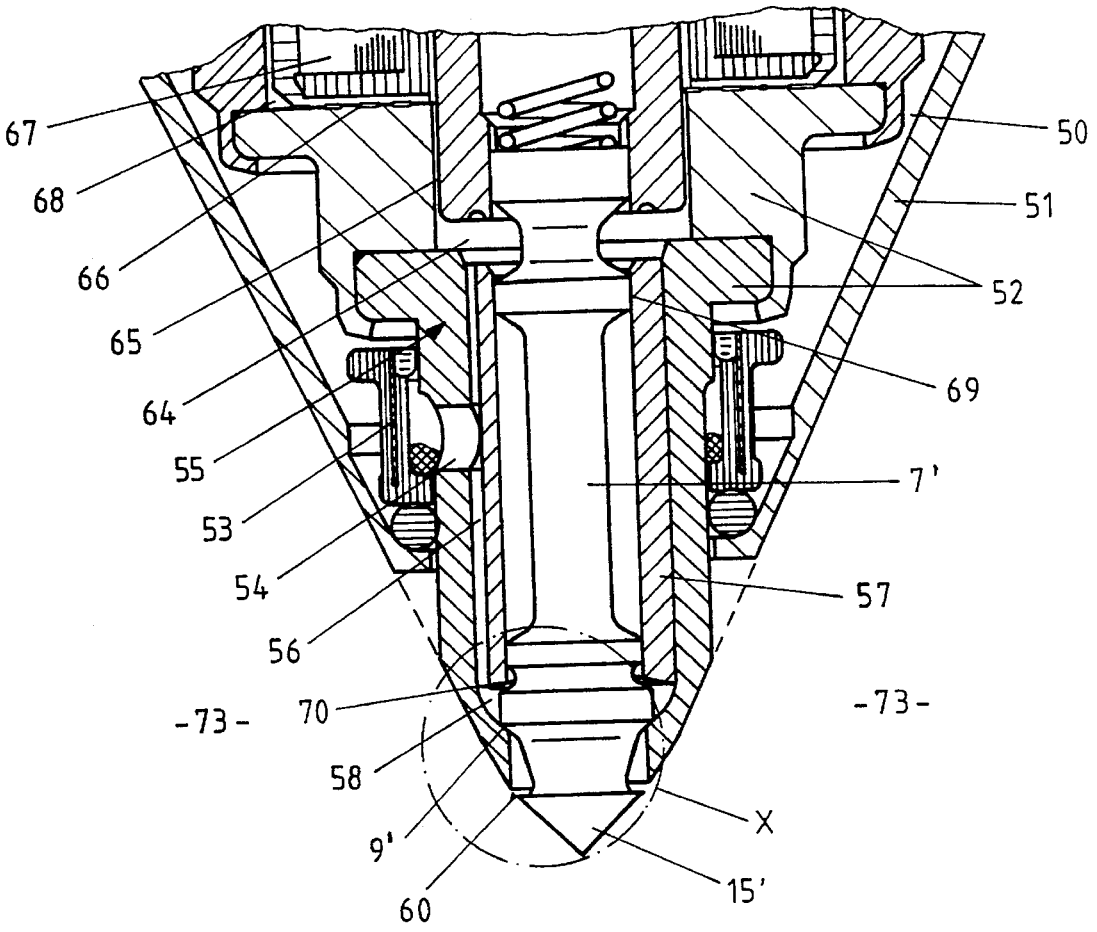
FIG. 4 shows a fourth preferred embodiment of the fuel injection valve according to the present invention wherein the configuration of the annular metering gap includes a valve needle end piece as the spray plate.

In FIG. 3, quantitative indications deliberately given for various dimensions are provided for better understanding of the invention and not as a limitation. Inflow bores 44, 45 are spatially offset, as depicted. Lastly, a further variant of the present invention can advantageously consist in the fact that the spray-off point is configured so as to move with the valve needle, for example as a valve needle end piece which then serves as the spray plate, as shown in FIG. 4. Detail X that is of specific interest here is depicted again in greater detail in FIG. 5 with the same reference numbers.

Figure 5:
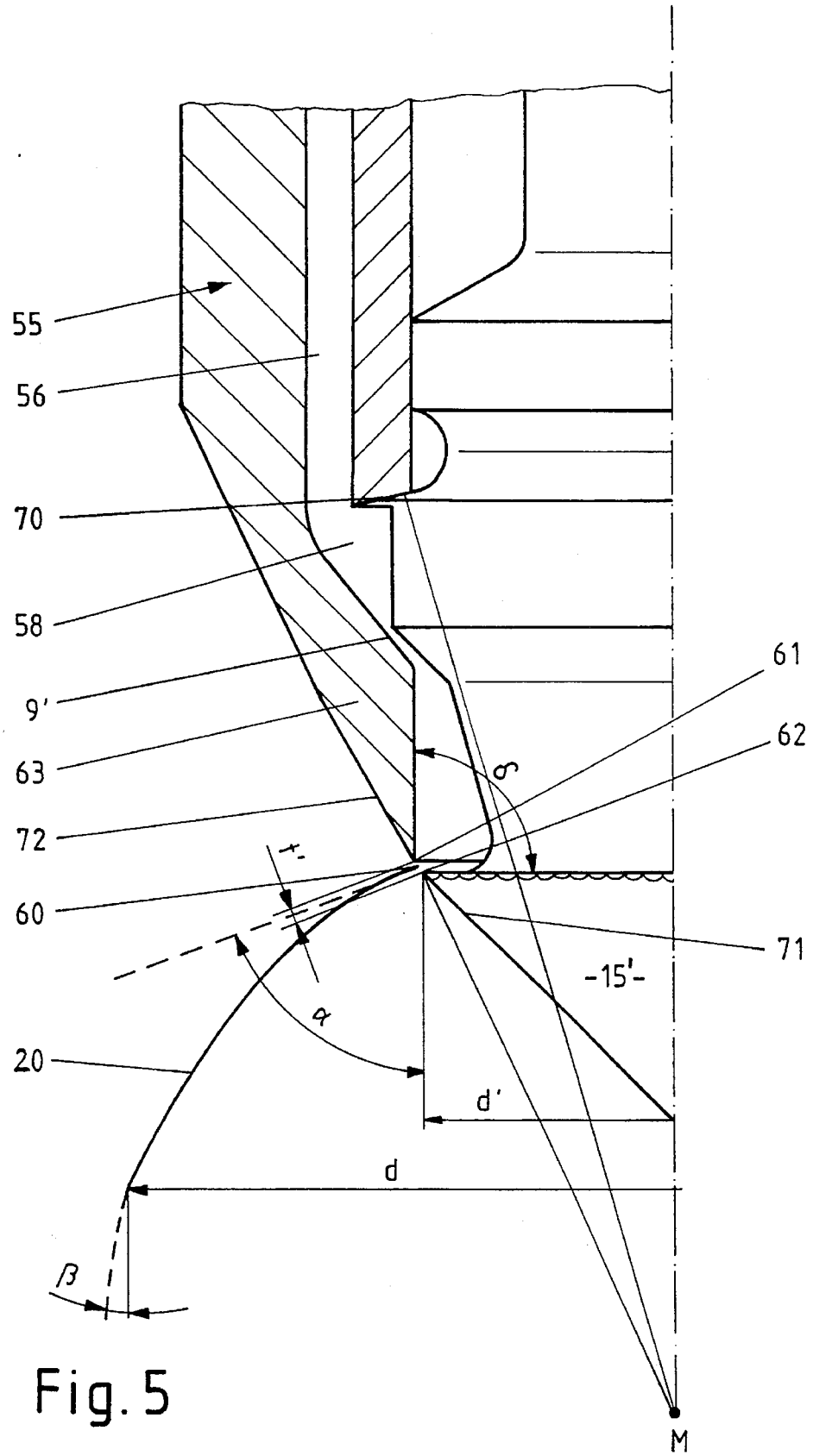
FIG. 5 shows the detail of area X of FIG. 4 on an enlarged scale for better illustrating the configuration of the annular metering gap constriction.

In the preferred embodiment shown in FIG. 4, fuel is delivered into space 50 between a mount 51 and the actual valve structure 52. Fuel moves through an annular filter 53 and passes through transverse bores 54 in nozzle body 55 and lengthwise slits 56 between nozzle body 55 and a valve guide sleeve 57 to an annular fuel distributor 58. From there it flows in circularly symmetrical fashion via valve seat 9' to annular metering gap 60. The two opposing annular edges 61 and 62 forming this annular gap 60 form an acute emergence angle α of approximately 60 degrees with the axis as shown in FIG. 5. The mutually facing inner surfaces of the components participating in formation of the annular metering gap enclose an angle, δ, of approximately 90 degrees, while the outer surfaces which taper to the sharp peripheral edges can each enclose angles of, for example, 30 degrees with the inner surfaces.

In the preferred embodiment shown in FIG. 5, the valve needle end piece forming lower edge 62, which in this context forms spray plate 15', has a shape which tapers conically downward. The upper opposite edge 61 of annular metering gap 60 consists of a downward-tapering apron part 63 of nozzle body 55.

Unsprayed fuel flows via lengthwise slits 56 to annular distributor 64 and from there, for example, through magnet air gap 65 and grooves 66 in magnet coil 67 to an annular distributor 68, from which the fuel is ultimately recirculated through a filter not depicted in the drawings.

When a clearance exists between valve needle 7' and bearing 69, the valve needle rotates in its conical upper stop 70 about a point M normal to the conical surface. The clearance between bearing 69 and metering gap 60 is greatly reduced in accordance with the distance ratio between bearing 69 and M and metering gap 60 and M. If point M is located approximately along the extension of peripheral edges 61, 62, metering gap 60 does not, to a first approximation, change with the clearance in bearing 69. The static volume of the valve can be set by displacing tube 57, forming stop 70, which constitutes the valve guide. As stop 70 wears, the static volume decreases; if wear occurs in the sealing seat, it rises. With a suitable design, the mean values can be compensated.

In the preferred embodiments shown in FIGS. 4 and 5, fuel lamella 20 is ejected at an angle, α, of approximately 60 degrees to the vertical axis. With an achievable droplet diameter of approximately 50 μm or less, its air resistance is especially high, as is also the reduction from emergence angle α to angle γ.

The preferred embodiments of FIGS. 1 through 5 result in additional advantages, including: low-frequency eddies are eliminated by the low-loss inflow angle δ=90 degrees to edges 61, 62; a low-loss taper for valve seat 9' is achieved; deceleration of the lamella and periodic droplet separation at emergence are prevented by the sharp and circularly symmetrical edges 61, 62; and lamella 20 is approximately perpendicular to the conical outer boundary of the spray-off edges, i.e. to outer surfaces which converge to form the edges—71 of valve needle end piece 15' acting as the spray plate and 72 of nozzle body 55.

As shown in FIGS. 4 and 5, in still air 73, angle γ is rather greater than is desirable for multipoint applications. However, flowing air 73 arrives at full velocity at the outlet of the thin lamella, which presents to it an air resistance that is even greater than even the smallest droplets, and is in fact infinite for a continuous lamella. Thus, not only is angle β reduced, but in multiple-valve engines the fuel is, as is desirable, blown onto the open intake valve, especially when the injection timing is set correctly. Wetting of the intake manifold can thereby be eliminated.

The fuel injection value according to the present invention is capable of supplying droplets whose diameters are statically and dynamically approximately 40% or more smaller than in previously known systems, for example those based on swirl valves. With reference to the preferred embodiments of FIGS. 4 and 5, in which the spray-off point moves with the needle, an additional result is that the spray angle α of the lamella decreases during the stroke and minimizes any overtaking of the lamella. Moreover, the lamella is additionally rotated against the movement direction, which can be a crucial advantage for conditioning.

What is claimed is:

1. An electromagnetically actuated fuel injection valve for a fuel injection system of an internal combustion engine, comprising:

a valve housing having a longitudinal opening disposed therethrough and a lower end;

a valve closing member disposed within the valve housing;

a valve seat disposed at the lower end of the valve housing for releasably supporting the valve closing member;

a magnet coil coupled to the valve closing member, wherein when the magnet coil is excited, the valve closing member lifts off the valve seat to allow fuel to pass through the valve seat;

a spray member holder connected to the valve housing, the spray member holder having a first annular periphery forming a first annular edge downstream from the valve seat; and a spray member connected to the spray member holder, the spray member being formed separately from the valve closing member, the spray member having a second annular periphery forming a second annular edge downstream from the valve seat and opposite the first annular edge, an annular metering gap being formed between the first and second annular edges to generate a fuel lamella of substantially laminar profile, the annular metering gap having a thickness of the fuel lamella.

2. The fuel injection valve of claim 1, wherein:

the spray member holder further includes a downwardly extending bore for receiving the spray member and thereby reducing dead volume.

3. The fuel injection valve of claim 2, wherein the spray member holder bore includes an inner periphery having slits for receiving fuel flowing through the valve seat.

4. The fuel injection valve of claim 1, wherein:

the spray member holder includes a plurality of spray member holders forming a plurality of first annular edges, and the spray member includes a plurality of spray members forming a plurality of second annular edges, each of the plurality of first annular edges being opposed to a respective one of the plurality of second annular edges, thereby forming a plurality of annular metering gaps, each of the plurality of annular metering gaps being arranged concentrically to provide concentric initially laminar fuel lamella sprays of fuel for fuel flowing through the valve seat.

5. The fuel injection valve of claim 4, wherein each of the plurality of first annular edges is opposed to each of the plurality of second annular edges at an acute angle so that each fuel lamella is sprayed off at a spray-off angle α, wherein $20° \leqq \alpha \leqq 60°$.

6. The fuel injection valve of claim 1, wherein the first annular edge is opposed to the second annular edge at an acute angle so that the fuel lamella is sprayed off at a spray-off angle α, wherein $20° \leqq \alpha \leqq 60°$.

7. The fuel injection valve of claim 1, wherein the first annular edge and the second annular edge define an annular distributor for fuel flowing through the valve seat.

8. An electromagnetically actuated fuel injection valve for a fuel injection system of an internal combustion engine, comprising:

a valve housing having a longitudinal opening disposed therethrough and a lower end;

a valve closing member disposed within the valve housing;

a valve seat disposed at the lower end of the valve housing for releasably supporting the valve closing member;

a magnet coil coupled to the valve closing member, wherein when the magnet coil is excited, the valve closing member lifts off the valve seat to allow fuel to pass through the valve seat;

a first spray member holder connected to the valve housing, the first spray member holder having an annular periphery and a first annular edge; and a first spray member formed separately from the valve closing member, the first spray member being connected to the first spray member holder, the first spray member having an annular periphery opposed to the first spray member holder annular periphery, thereby forming a first annular distributor to receive fuel passed through the valve seat, the first spray member also having a second annular edge opposed to the first annular edge, thereby forming a first annular metering gap between the first and second annular edges to generate a fuel lamella of substantially laminar profile when fuel passes through the first annular distributor.

9. The fuel injection valve of claim 8, further comprising:

a second spray member connected to the first spray member, the second spray member having an annular periphery and a third annular edge; and wherein the first spray member further includes an additional annular periphery opposed to the second spray member annular periphery, thereby forming a second annular distributor to receive fuel passed through the valve seat, and a fourth annular edge opposed to the third annular edge, thereby forming a second annular metering gap between the third and fourth annular edges to generate a fuel lamella of substantially laminar profile when fuel passes through the second annular distributor.

10. An electromagnetically actuated fuel injection valve for a fuel injection system of an internal combustion engine, comprising:

a valve housing having a longitudinal opening disposed therethrough and a lower end;

a valve closing member disposed within the valve housing;

a valve seat disposed at the lower end of the valve housing for releasably supporting the valve closing member;

a magnet coil coupled to the valve closing member, wherein when the magnet coil is excited, the valve closing member lifts off the valve seat to allow fuel to pass through the valve seat;

a spray member connected to the valve housing, the spray member being formed separately from the valve closing member and including a surface layer, the surface layer having at least one annular metering gap formed by a first annular edge opposed to a second annular edge, a direction of the surface layer and a direction of the at least one annular metering gap defining a spray-off angle running conically outward; and at least one annular distributor connected to the spray member for supplying fuel to the at least one annular metering gap when fuel flows past the valve seat to thereby generate a fuel lamella of substantially laminar profile when fuel passes through the at least one annular distributor.

11. The fuel injection valve of claim 10, wherein:

the spray member further includes a plurality of first annular edges each opposed to one of a respective plurality of second annular edges thereby forming a plurality of annular metering gaps; and the at least one annular distributor includes a plurality of annular distributors to supply fuel to each of the respective plurality of annular metering gaps, thereby providing concentric initially laminar fuel lamella sprays of fuel for fuel flowing through each of the respective plurality of annular distributors.

12. The fuel injection valve of claim 10, wherein the first annular edge is opposed to the second annular edge at an acute angle so that the fuel lamella is sprayed off at a spray-off angle $\alpha$, wherein $20° \leqq \alpha \leqq 60°$.

13. An electromagnetically actuated fuel injection valve for a fuel injection system of an internal combustion engine, comprising:

a valve housing having a longitudinal opening disposed therethrough and a lower end, the lower end defining an annular edge;

a valve closing member disposed within the valve housing;

a valve seat disposed at the lower end of the valve housing for releasably supporting the valve closing member;

a magnet coil coupled to the valve closing member, whereby when the magnet coil is excited, the valve closing member lifts off the valve seat to allow fuel to pass through the valve seat;

wherein the valve closing member includes a valve needle having a lower end forming a spray member having an annular edge opposed to the valve housing annular edge, the valve housing annular edge and the spray member annular edge enclosing an angle of approximately 90°, thereby forming an annular metering gap between the annular edges to generate a fuel lamella of substantially laminar profile when fuel passes through the valve seat.

* * * * *